United States Patent [19]

Marshall et al.

[11] Patent Number: 4,923,402

[45] Date of Patent: May 8, 1990

[54] MARKSMANSHIP EXPERT TRAINER

[75] Inventors: Albert H. Marshall; Robert T. McCormack, both of Orlando; Edward J. Purvis, Winter Park; Ronald S. Wolff, Cocoa; Herbert C. Towle, Winter Park, all of Fla.

[73] Assignee: The United States of America as represented by the Secretary of the Navy, Washington, D.C.

[21] Appl. No.: 276,257

[22] Filed: Nov. 25, 1988

[51] Int. Cl.[5] ..... F41G 3/26

[52] U.S. Cl. ..... 434/22; 434/18; 434/19; 434/20; 434/21; 273/310; 273/312; 235/472; 250/216; 340/708; 350/481; 364/237.1; 364/916.5

[58] Field of Search ..... 434/17–24, 434/356; 273/1 E, 323, 310–312, 371, 372; 364/237.1, 916.5; 358/93; 235/472, 464; 250/203, 216, 221; 350/481; 340/707, 708

[56] References Cited

U.S. PATENT DOCUMENTS

| | | | |
|---|---|---|---|
| H186 | 1/1987 | Marshall et al. | 434/18 |
| 4,229,103 | 10/1980 | Hipp | 356/141 |
| 4,336,018 | 6/1982 | Marshall et al. | 434/22 |
| 4,340,370 | 7/1982 | Marshall et al. | 434/22 |
| 4,395,045 | 7/1983 | Baer | 273/312 |
| 4,457,715 | 7/1984 | Knight et al. | 434/22 |
| 4,583,950 | 4/1986 | Schroeder | 434/22 |
| 4,591,841 | 5/1986 | Gunderson et al. | 340/707 |
| 4,619,616 | 10/1986 | Clarke | 434/22 |
| 4,804,325 | 2/1989 | Willits et al. | 434/19 X |
| 4,844,476 | 7/1989 | Becker | 340/707 X |

FOREIGN PATENT DOCUMENTS

| | | | |
|---|---|---|---|
| 1033839 | 8/1983 | U.S.S.R. | 434/19 |

OTHER PUBLICATIONS

"Low Cost Personal Computer Rifle Marksmanship Expert Trainer (MET)" by Marshall et al, Interservice/Industry Training System Conference, Nov. 30–Dec. 2, 1987, pp. 226–232.

*Primary Examiner*—Richard J. Apley
*Assistant Examiner*—Joe H. Cheng
*Attorney, Agent, or Firm*—Robert W. Adams

[57] ABSTRACT

The invention is a marksmanship trainer that can accommodate a plurality of trainees. The trainer includes a long range light pen to measure sighting accuracy and tracking steadiness. It is set with the sight of a simulated or operational weapon, and achieves resolution to the pixel level by using telescope optics and special purpose circuitry in addition to its computer board. Each trainee is provided with a raster scan display and a computer that provide a target image and corrective feedback to the trainee. Bridge configured dual strain gauges are used to sense breathing, and a force sensing resistor is used to monitor trigger squeeze. Recoil is simulated mechanically, and a simulated report of the weapon is provided through a headset. The feedback of corrective action is provided aurally/graphically from a stored expert library.

12 Claims, 3 Drawing Sheets

MARKSMANSHIP EXPERT TRAINER

BACKGROUND OF THE INVENTION

1. Field of the Invention

The present invention relates to the field of training devices, and more specifically, to the field of marksmanship training for weapons having an aim-point sight, such as rifles and handguns. In particular, the invention is a simulator in which the trainee acquires and/or perfects his marksmanship skills without the expenditure of live ammunition and the risk of injury to himself and others that is inherent on the traditional rifle range.

2. Description of the Prior Art

People have historically learned to shoot on outdoor ranges, the locations of which were selected for their remoteness in order to promote safety. The trainees lined-up on one side, on the other side the targets were placed against a protective backdrop such as a sand hill. The area beyond the targets was restricted for great distances due to the long range of the weapons, which resulted in a large amount of land being required for each range. In addition, rigid discipline was practiced along the firing line to prevent accidents.

Now, simulators are used in lieu of live ammunition, with the result that the injury that could have resulted from a trainee's negligence virtually has been eliminated. However, simulators that have been available do not accurately duplicate the complete training experience that one receives by shooting live rounds in the operational weapon. Most simulators are quite elaborate and complicated, and are expensive to acquire and operate.

U.S. Pat. No. 4,336,018 issued to some of the present inventors and others, discloses an electro-optic infantry weapons training system for simulating the firing of a quintet of weapons at a visual target which appears on a screen. A quintet of trainee riflemen, each of whom is holding a weapon, aim and fire the weapons at the visual target. A visual projector projects upon the screen a background scene including the visual target, while an infrared projector simultaneously projects an infrared target on the screen. Each weapon includes a sensor element for sensing the infrared target whenever the weapon is correctly aimed at the visual target. The sensor elements are connected in a combination with sensor circuits, enable circuits, and an interface circuit so as to provide to a microprocessor computer and an eight-bit microcomputer data words which indicate whether each of the quintet of trainee riflemen have scored a hit upon the visual target. The microprocessor computer then supplies a message to a voice unit so as to indicate through headphones to an instructor and each of the quintet of trainee riflemen whether the trainee rifleman has scored a hit upon the visual target. The eight-bit microcomputer supplies to a data CRT display a message so as to indicate to the instructor whether each of the five trainee riflemen have scored a hit upon the visual target. At the conclusion of a training session, the microprocessor computer will supply to a data terminal the results of the training session in accordance with a message format. A recoil simulator is shown by the patent, as is a gun soundburst synthesizer in conjunction with the headset.

U.S. Pat. No. 4,340,370 issued to some of the present inventors and others, discloses a linear motion and pop-up target training system for training a marksmanship to fire a simulated weapon. Located on a terrain surface of a modelboard are six pop-up targets and three bi-directional linear motion targets, each of which emits a pulsed beam of infrared light when activated by a first microprocessor computer. Mounted on the weapon is a sensor which will sense the pulsed beam of infrared light emitted by the activated target. The sensor then supplies to a rifle electronics circuit, an analog signal proportional to the amount of light received by the sensor. The rifle electronics circuit converts the analog signal to a digital logic signal to be supplied to a second microprocessor computer. The second microprocessor computer then processes the digital logic signal in accordance with a predetermined computer program so as to determine whether the marksman has scored a hit, a miss, or a near miss upon the activated target. A voice unit and bang circuit are included in conjunction with a headset for the trainee.

Statutory invention registration H186 issued to some of the present inventors and others, discloses a recoil simulator that electro-mechanically applies an adjustable impulse force through a flexible cable attached to the butt of a weapon simulator when the firing trigger of the weapon simulator is actuated by the trainee.

U.S. Pat. No. 4,583,950 discloses a light pen for use with a dummy weapon and a target image displayed on a television monitor. The light pen is adapted to include a converging lens system in order to enhance the definition of the group of phosphor dots to which the pen is responding, at distances from four feet to twenty feet from the monitor. The trigger of the dummy weapon is manipulated by the trainee when he perceives the correct orientation between the dummy weapon and the microcomputer/videodisc-player generated target. Trajectory is purportedly calculated by the computer in order to generate and display the impact point. To complete the disclosure, reliance is placed on the statement that an Apple Language Card with Pascal language software, is suitable for enabling appropriate images to appear on the screen and for executing the necessary trajectory and shot impact response calculation.

U.S. Pat. No. 4,395,045 discloses a marksmanship trainer and game employing a simulated rifle that cooperates wirelessly with a television receiver on which is displayed the intended target. Manipulation of the trigger on the rifle causes a photo diode to emit infrared radiation that is received by a special box attached to the TV that, in turn, flashes the screen white in order to provide enough illumination to be sensed by a photodetector on the rifle. The resultant signal generated at the rifle again triggers the infrared emitter which this time is received by the special box for calculating the numerical horizontal position at which the rifle was pointing, and counting the vertical lines to which the scan had traced when the trigger was manipulated. The signal generated by the photodetector on the rifle in response to the bright screen is a series of pulses corresponding to the several raster scan-line portions that are simultaneously within its field of view. The leading edge of the pulses denotes the placement of the portions as they appear horizontally on the screen, which is measured by counting in one-half microsecond intervals from the immediately preceding horizontal sync to the leading edge of the pulse. Vertical placement is measured by counting the number of lines that have been scanned horizontally from vertical sync to the leading edge of the first pulse. Accuracy is purported to be within 1% to 2%.

U.S. Pat. No. 4,457,715 discloses a pressure sensor that is shown as a modification to a rifle in order to adapt the rifle for training. The sensor includes a transducer having a foam core made from carbon impregnated polystyrene that changes electrical resistance when subjected to pressure. When the carbon particles in the foam core are compacted by added pressure, the transducer's current flow or voltage drop responds in relationship to the amount of pressure that is applied.

The above-described disclosures are representative of the state-of-the-art that was available in marksmanship training systems and components before the present invention. Alone and when taken together they have deficiencies and disadvantages that limit their effectiveness for training. Accordingly, a purpose of the present invention is to improve the state of marksmanship trainers by providing a system that addresses all characteristics of the expert marksman, monitors the trainee's performance in each aspect of proper technique and practices, and provides enhanced realism to the training session and a complete review of the trainee's performance along with specific guidance available aurally and/or visually from a library prepared to correct all errors in performance that deviate from the techniques practiced by an expert marksman.

SUMMARY OF THE INVENTION

The present invention is a surrogate expert instructor in computerized form that is described in the disclosed embodiment for application to the field of weapons marksmanship. A microcomputer, monitor or other raster scan display device, and weapon are included, as is a conventional light pen adapted for use at a spaced distance from the monitor. A digitized image that is stored in the computer or provided by a videodisc player, is processed and controlled by the computer, and then presented on the monitor. The trainee handles the unarmed weapon in operational fashion to track the target and manipulate the trigger. Recoil of the weapon is realistically simulated with physical force; and, soundburst is generated and provided through a headset. Sensors monitor the trainee's breathing and trigger squeeze. The light pen is aligned with the sight of the weapon and senses the point of light that is traced by the raster scan on the monitor to create the display. The pen provides a pulse to the computer when the point of light is detected. In response, the computer reads the values in counters that are controlled by the horizontal and vertical sync of the monitor, which values define the location on the screen of the pen placement. The computer compares the trainee's target tracking, breathing pattern, and trigger manipulation to a preselected set of parameters that characterize the skilled marksman, and provides aural/visual feedback to the trainee from the computerized expert instructor denoting specific corrective action.

The computer includes a computer speech board, and an analog and digital input/output board. An arrangement of strain gauges placed on the trainee's abdomen may function as the breath sensor. The sensor is used to determine whether the trainee held his breath prior to manipulating the trigger. The output of the gauge is coupled to an analog-to-digital converter. A miniature force sensing resistor prepared on mylar and operated in the shunt mode is fitted to the weapon's trigger. It is used to determine whether the trainee is properly squeezing the trigger, or is jerking it. The output of the resistor is linearized and coupled to the A/D converter. The light pen is adapted for long range use by adding a small two lens element optical telescope to limit the pen's field of view. Single pixel resolution on the monitor's screen can be distinguished by the pen at ranges up to twenty feet from the screen. The output of the pen's detector is processed by special purpose circuitry and coupled to the pen's computer board.

An instructor station also may be included. It can monitor and communicate with a plurality of trainee stations.

DESCRIPTION OF THE PREFERRED EMBODIMENT

Figure 1:
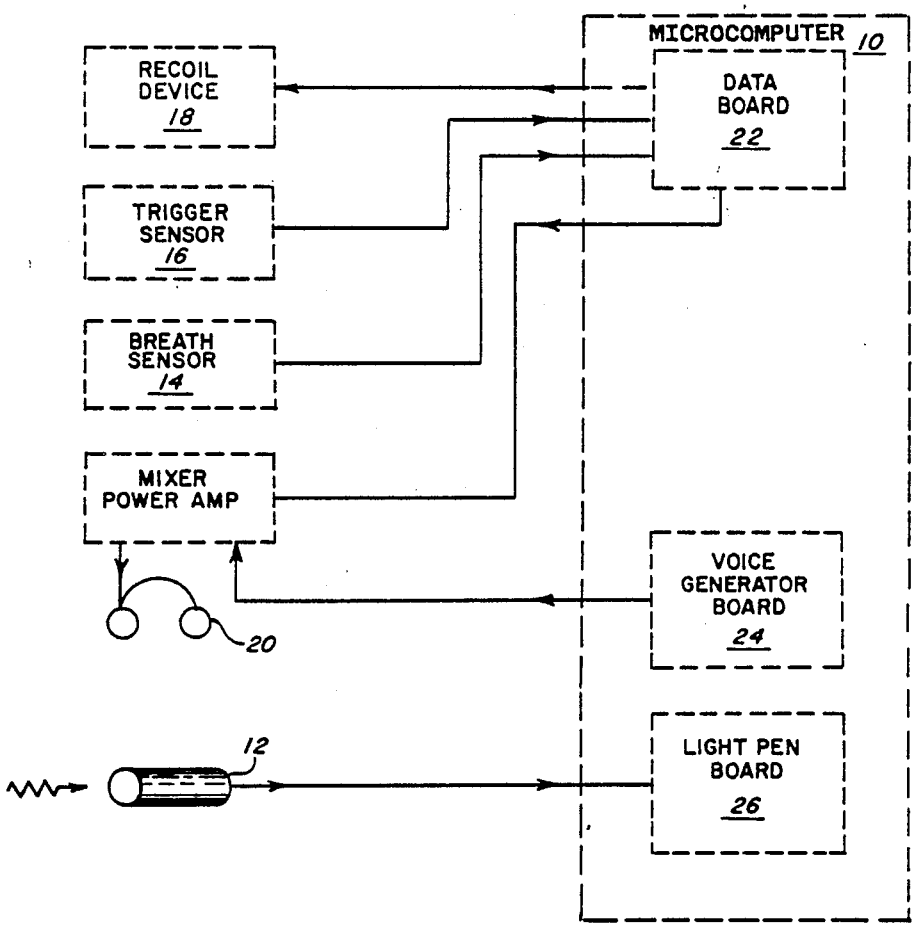
FIG. 1 is a block diagram of a marksmanship expert trainer.

The expert system of the present invention is shown in FIG. 1 configured for marksmanship training to include microcomputer 10 in communication with light pen 12, breath sensor 14, and trigger-squeeze sensor 16. Immediate feedback is provided from the programmed computer to the trainee through recoil device 18 and headset 20 in accordance with the data gathered by data board 22. Microcomputer 10 may be conventional though adapted to include data board 22, voice generator 24, and special purpose board 26 selected or prepared to enhance the modifications to, or design of, a light pen for use at long range as weapon-mounted light pen 12. Feedback also is available immediately and/or at the end of the training sequence aurally through headset 20, and/or graphically on a visual display device that is not shown in FIG. 1.

The embodiment is based on the four fundamentals of shooting: (1) Assume a steady position, (2) Put the front sight post of the weapon on the target, (3) Stop breathing, and (4) Squeeze the trigger. Light pen 12, designed or specially adapted for high-resolution at long range, is attached to the weapon and targets are displayed on a display device. Light pen 12 is utilized to determine the steadiness by which the trainee tracks the target, and the accuracy of the alignment by trainee of the weapon on the target image when the weapon's trigger is manipulated. Breathing is monitored by a set of strain gauges placed on the trainee to sense movement in his diaphragm and determine whether the trainee was holding his breath prior to, and throughout, manipulation of the trigger. And, a force sensing resistor prepared for placement on the trigger to monitor the pressure that is applied by the trainee, is used to determine whether the trigger was squeezed, as compared to jerked.

The embodiment is described by the following characteristics. Shot location is identified by orthogonal axis coordinates in which the X-axis has a range of 0 to 639 partitions discernible by the system, and the Y-axis has a range of 0 to 199 discernible partitions. Tracking data are X and Y coordinate data recorded at a rate of sixty hertz. Thirty coordinate locations are stored in a circular buffer which represents one-half second in real-time. The stored locations are continuously updated prior to manipulation of the trigger by the trainee, and are an indication of the trainee's ability to maintain a steady sight on the target image. Data from the force sensing resistor on the trigger is converted from analog to digital, and stored in a circular buffer also at sixty hertz. Analysis of force versus time for the quarter-second period before weapon fire, shows whether the trigger was manipulated by a steady squeeze, or was operated improperly. Data from the strain gauge on the breath-sensor belt is converted from analog to digital, and stored in a circular buffer also at sixty hertz. Analysis of motion versus time for the one-second period before weapon fire, shows whether the trainee had frozen his breathing, or was inhaling/exhaling, prior to and during manipulation of the trigger.

Mathematical functions are calculated on the data obtained from the above-identified sensors for use by the computerized expert system for analysis and appropriate/corrective feedback to the trainee using a computer generated voice and/or graphics on the display device. For example, the following functions are calculated. The X-mean and X-standard deviation of the shot group, the Y-mean and Y-standard deviation of the shot group, and the diameter of the shot group, are calculated from the locations detected for a plurality of shots, such as a training set of ten shots. Likewise, the mean and standard deviation for each coordinate is calculated on the tracking data for the plurality of shots. The data from the breath sensor are compared for variation during the one-second period prior to weapon fire, to detect breathing by the trainee.

Figure 2:
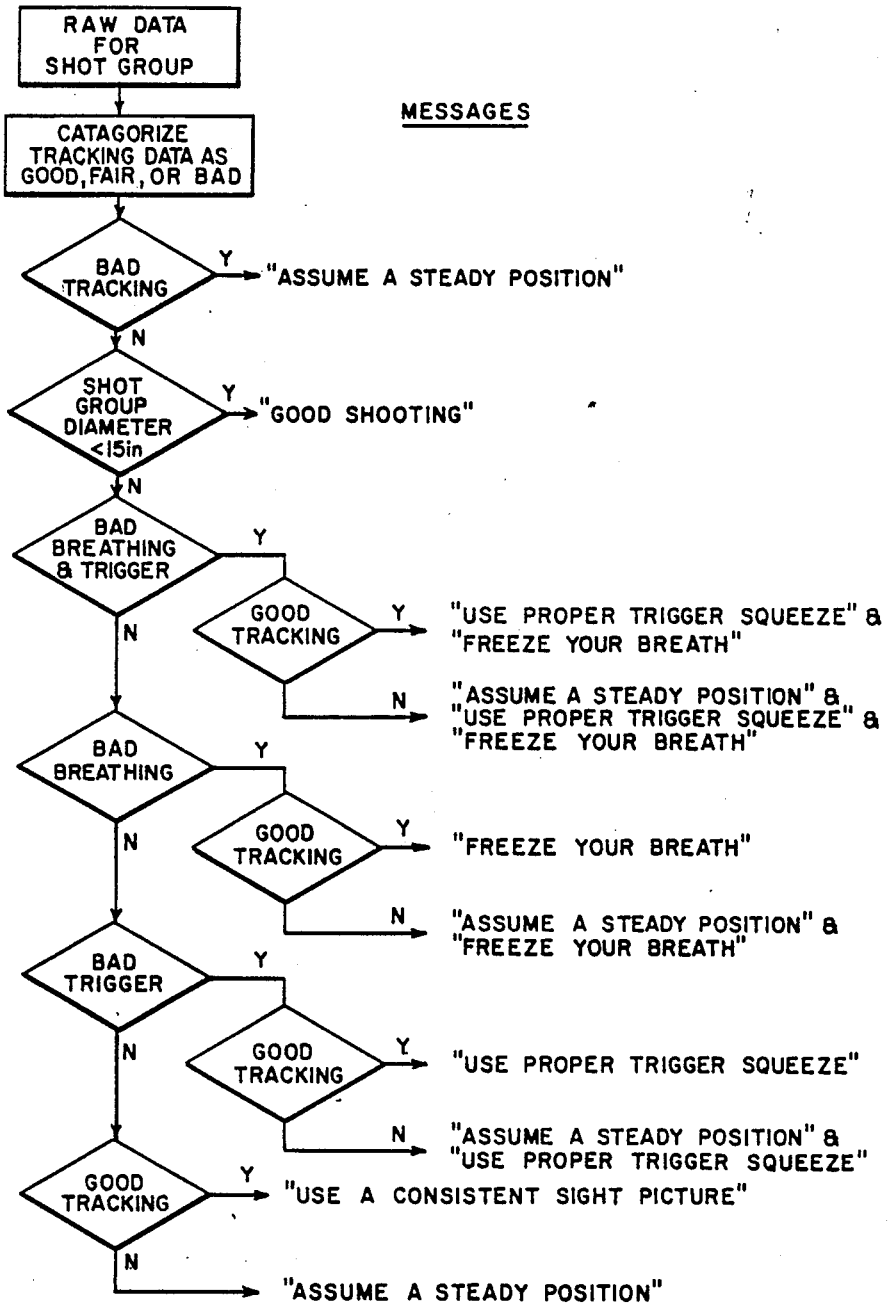
FIG. 2 is a flow chart of the expert system of the preferred embodiment.

The computerized expert system responds to the above-calculated functions and generates feedback to the trainee. FIG. 2 shows the decision flow-chart used in the embodiment. The flow-chart is self-explanatory, and accordingly, will not be described herein. However, the messages shown on the flow-chart denote communications that are conveyed to the trainee and/or an instructor at an instructor's station, if one is included. For example, the message, "good shooting" may appear graphically in print or on one or more display device(s), and/or be expressed by voice generator to the trainee and/or instructor through a headset, speaker, or other reproduction device. Further, the criteria for—bad tracking—, as an example, is definable during the programming operation and may be adjusted as desired to employ the acquired data in a preferred manner for a particular application. All such variations, of course, are within the scope of the present invention, including variations in program language or code that are a matter of choice.

Note that the messages communicated to the trainee are specific in their recommendations for corrective action. The present invention is able to diagnose improper conduct and provide specific solutions because the invention monitors an array of characteristics that fully define the epitome of an expert performance; and, the computerized expert system fully defines the expert and is complete in its consideration, evaluation and analysis of the gathered data against that standard.

Figure 3:
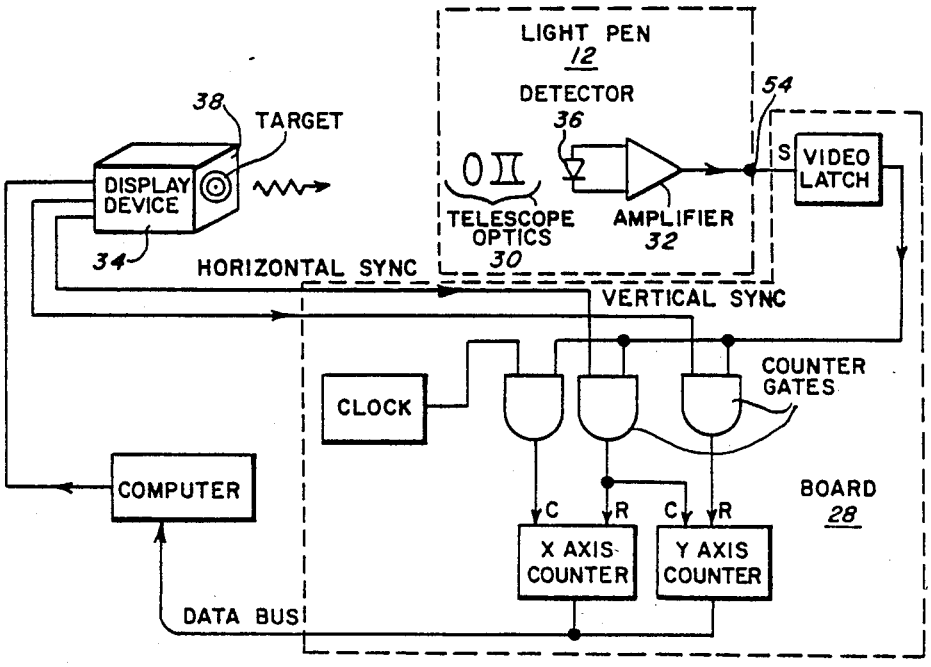
FIG. 3 is a schematic diagram partially in block form of the long range light pen as it relates to the trainee's station; and, FIG. 4 is a schematic diagram of the special purpose light pen circuit board associated with the weapon.

FIG. 3 shows a complete view of the invention associated with the trainee station, with emphasis on light pen 12 and its computer board 28. Light pen 12 has been adapted to include two-element telescope optics 30 and amplifier 32. The light pen also has been adapted in that the weapon's trigger is wired as a switch and substituted for the push tip switch of the light pen. Light pen 12 constantly is open to detect the scanned spot on the display device and provide a pulse to board 28. The switch in the weapon's trigger communicates directly with the computer which is programmed to correlate the moment of manipulation of the trigger with the location at which the scanned spot is detected by light pen 12, and the relationship of that location with the programmed target.

Telescope optics 30 limits to a small area the amount of the screen on raster scan display device 34 that is viewed by light pen 12, which with the pen's special purpose circuitry and computer board 28 achieve pixel-size resolution for the long-range system. Photodiode detector 36 includes an eye-response optical filter. When the raster scanned dot on display device 34 is sensed by detector 36, a current pulse is produced and coupled to transimpedance amplifier 32 which converts the current to a voltage that is then amplified and provided to the input of computer board 28. Board 28 is conventional for commercially available light pens and is provided by light pen, and light pen board, manufacturers/suppliers. A suitable board for the embodiment described is the PXL-350 Hi-Res Light Pen Board available from FTG Data Systems of Stanton, Calif. Board 28 on FIG. 3 shows the commercially available board in block diagram form. The video latch operates in response to the above-described output from amplifier 32, to pulse each of the three gates shown connected to the X-axis, and Y-axis, counters in order to momentarily freeze the counters. After the computer reads the counters in accordance with the software program, the computer clears the video latch and restores the counters to an enabled state. The data in the counters identifies the X and Y location on screen 38 of the area being viewed by light pen 12 when the raster scanned dot is sensed by detector 36. A separate twelve-bit counter is used for the X coordinate, and for the Y coordinate. The X-axis counter is clocked with a thirty-megahertz signal for processing single pixel resolution on screen 38. The X-axis counter is reset to zero by the horizontal retrace sync pulse from display device 34. The Y-axis counter counts horizontal sync pulses as a way of counting horizontal lines which, in turn, identifies vertical location. The Y-axis counter is reset to zero on the vertical retrace sync pulse from display device 34.

When the raster-scanned light spot is sensed by detector 36 of light pen 12, the video latch triggers reset signals to the X and Y counters that interrupt the clock. Thereby, the counters are frozen with the X and Y coordinate data that corresponds to the location on screen 38 of the detected spot, until the computer program reads the counters and clears the video latch, as above-described.

Light pen 12 is adapted to include telescope optics 30 in order to gather sufficient light to be sensed by detector 36 from the spot that is scanned across the raster of screen 38. The spot is relatively low in intensity and would not be detected by conventional light pens that are designed for use in close proximity to screen 38. Suitable for use in the embodiment with the above-identified light pen board, is a two-element optic system having a first bi-convex lens, and a second bi-concave lens, as shown in FIG. 3. Using two elements minimizes the weight of the optics which is a substantial factor in an embodiment where significant weight would diminish its utility, such as here where extra weight near the end of the barrel would tire the trainee and degrade realism by altering the feel and handling of the weapon. The convex lens element is used to gather light and may have a diameter of 25.0 mm and a focal length of 63.5 mm. The concave lens element is used to spread the image as much as possible and may have a diameter of 14.0 mm and a focal length of (−)18 mm. The difference between the absolute values of their focal lengths is the spacing between the lenses, and for the described embodiment is 45.5 mm, adjustable plus or minus 10mm. The concave lens should be spaced 40 mm from the photodiode of detector 36. The ratio of the absolute value of the focal length of the convex lens element, to the absolute value of the focal length of the concave lens element, is the magnification of the optic system, and for the described embodiment is 3.53. With this optic system, approximately twenty scan lines of screen 38 will appear on the surface of the photodiode of detector 36. Which twenty lines, of course, will depend on the trainee and where he is aiming.

Figure 4:
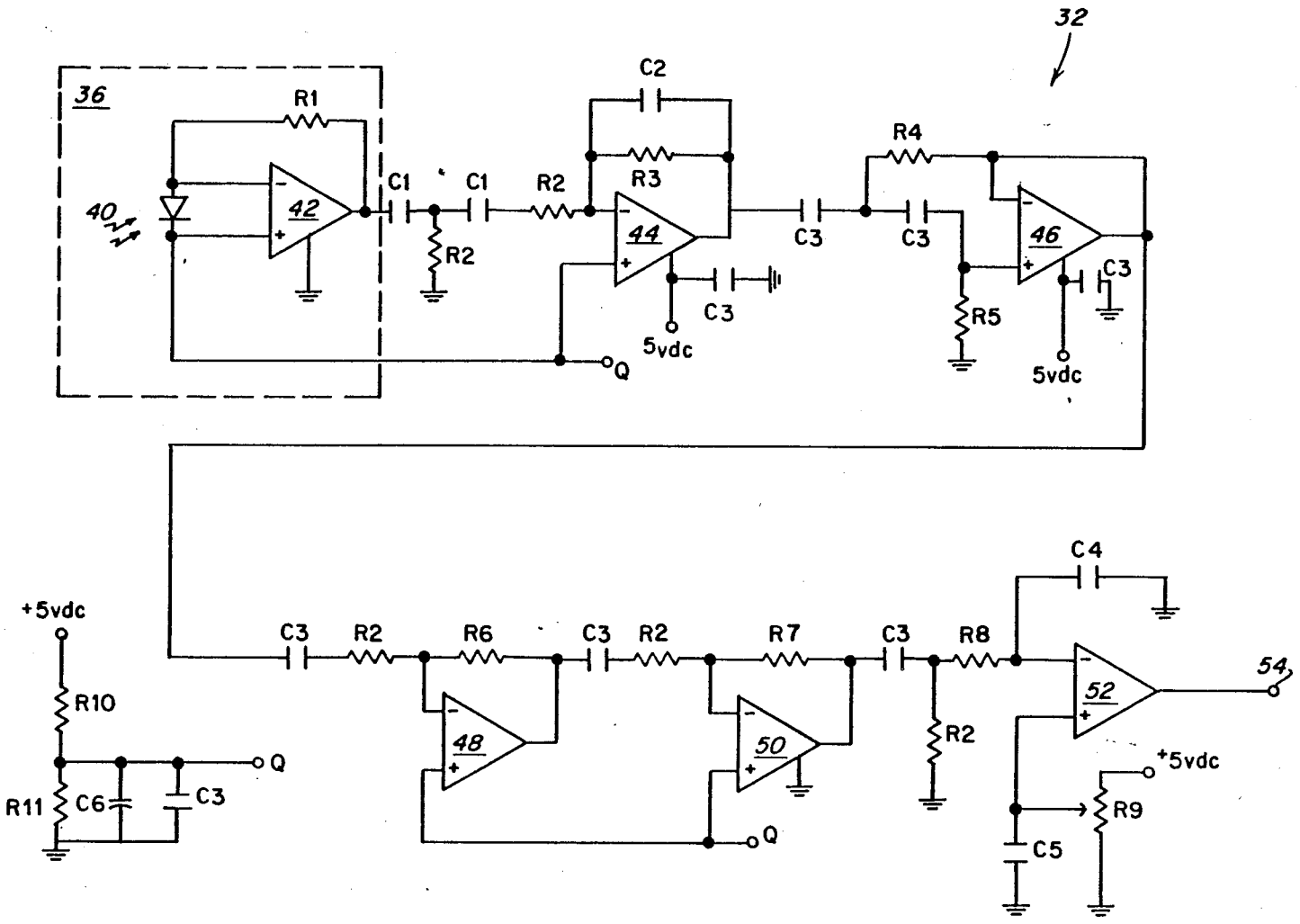

Also, light pen 12 includes the special purpose circuitry shown in FIG. 4. The circuitry includes a transimpedance amplifier that converts the current of light pen 12 to a voltage that is then amplified. Several electronic filters are used to eliminate power ripple and interfering light sources. For an embodiment with the below-identified values for the components shown in FIG. 4, the filter has a cut in frequency of 14 KHz. Photodiode 40 of detector 36 acts as a current source upon sensing the light spot scanned on screen 38. Amplifier 42 converts the current to a voltage. The voltage is AC-coupled to amplifier 44. Also, the two amplifiers form a pre-amplifier stage. Amplifier 46 is a second order low-pass Butterworth filter. Amplifiers 48 and 50 are AC-coupled gain stages. Amplifier 52 acts as a comparator that provides an output 54 to computer board 28 to accurately clock the X-axis counter and the Y-axis counter. The circuit may operate from the computer's power supply. The filtering shown in FIG. 4 for the power supply, is included to minimize jitter. Component values for a representative embodiment of the circuit shown in FIG. 4, may be as follows:

| Component | Value/Type |
|---|---|
| 40 | OSD 1E |
| 42 | MC34072AP (VCC-8; GND-4) |
| 44 | " |
| 46 | MC24074AP (VCC-4; GND-11) |
| 48 | " |
| 50 | " |
| 52 | " |
| R1 | 10 M |
| R2 | 10K |
| R3 | 150K |
| R4 | 820 ohm |
| R5 | 1.5K |
| R6 | 100K |
| R7 | 220K |
| R8 | 33 K |
| R9 | 100K (adj) |
| R10 | 6.8K |
| R11 | 3.9K |
| C1 | 1 nf |
| C2 | 39 pf |
| C3 | 10 nf |
| C4 | 33 pf |
| C5 | 10 mf |
| C6 | 15 mf |

Trigger sensor 16 uses a force sensing resistor (FSR). In such resistors, the resistivity across the device drops in a non-linear fashion as the force applied perpendicular to the sensor, is increased. The resistor is formed of two parts sandwiched together. The first part is a special conductive polymer. The second part is a conductive finger arrangement. The two parts are formed by silk-screening the appropriate materials onto mylar sheets of various thickness, size and shape. For the described embodiment, a very small Shunt-mode style FSR was constructed on five-mil mylar and placed on the surface of the trigger. A non-linear amplifier utilizing the characteristics of an ordinary diode was used to linearize the sensor such that useful analog data could be obtained. Then, the signal was conditioned for input to the below-described A/D converter.

Breath sensor 14 uses two strain gauges in a bridge configuration to double overall sensitivity. The sensors are mounted on a flexible material that will flex with the trainee's breathing. The very small electrical signal that is generated from the bridge arrangement is amplified by a differential instrumentation amplifier, filtered and conditioned for input to the A/D converter.

Recoil by recoil device 18 is simulated by pulling the weapon from the rear with a flexible cable. The recoil simulator comprises an electric motor, electro-magnetic clutch and flywheel. When the rifle is fired, the clutch is energized for a selectable period of milliseconds causing the flywheel to be engaged that, in turn, pulls the cable. For optimum realism, the cable should be in-line with the barrel of the weapon. Accordingly, the device should be adjustable to accommodate any firing position. The recoil device disclosed in above-identified Statutory Invention Registration H186 is suitable for use in the present invention.

A commercially available eight channel, high speed A/D converter board, from MetraByte, Model DAS-8, having twelve-bit resolution, may be used to collect data from breath sensor 14 and trigger sensor 16. Also, it may be used to control recoil device 18.

A commercially available computer board may be used for voice generation board 24. A board that both records over the audio range from a microphone, and playback, would be appropriate. When you make your selection, take into consideration your computer program and choose a board that will interface well with the program. A board that is suitable for the present embodiment is the ANTEX VP-600 recording and playback board.

The above-identified computer boards, including A/D data board 22, voice generator board 24, and light per board 26, are compatible with a variety of microprocessors such as the Zenith 248, all of which are suitable for use as computer 10.

From the foregoing description, it may readily be seen that the present invention comprises a new, unique, and exceedingly useful marksmanship expert trainer which constitues a considerable improvement over the known prior art. Obviously, many modifications and variations of the present invention are possible in light of the above teachings. It is, therefore, to be understood that within the scope of the appended claims the present invention may be practiced otherwise than as specifically described.

What is claimed is:

1. A marksmanship trainer having various sensors and a computerized expert instructor that monitors, scores and provides feedback to the trainee, wherein the target image is visually displayed and controlled on a raster scan by the computer, and the trainee's weapon includes a long range light pen receiver that permits the trainee's aim point on the display to be tracked up to, and through, trigger squeeze, comprising:

means for representing in physical appearance a weapon having a barrel and sight;

optical receiving means mounted for movement with said weapon means and aligned with said sight, for magnifying and continuously detecting a spot of light within its field of view, said receiving means comprising a light pen apparatus that includes a two-element optic system having a first bi-convex lens and a second bi-concave lens, a detector which provides a current signal at its output responsive to said spot of light, and circuitry that comprises means coupled to said output of said detector for converting said current signal to a voltage signal and electronic means for filtering and amplifying said voltage signal;

means for providing an image visible to the trainee, wherein a spot of light detectable by said detector is scanned in a raster fashion;

circuit means coupled to said image means and said receiving means for determining the aim point by identifying the location of said spot of light at the pixel level when said spot of light is detected by said receiving means, and for correlating said aim point to said image, said circuit means comprising a video latch connected to said electronic means, first and second counters having outputs coupled to said image means and the inputs of said first and second counters connected to the outputs of a plurality of gates, and the inputs of said plurality of gates are connected to said video latch for measuring the horizontal and vertical locations, respectively, of said spot of light to determine said aim point;

processing means coupled to said circuit means and said image means for comparing the correlation between the aim point and the image to the criteria that corresponds to the quality of trainee performance; and, means responsive to said processing means for communicating corrective feedback to said trainee that is preselected for corresponding to the results of said comparison from data, said data is representative of an expert marksmanship instructor.

2. The trainer of claim 1 wherein said field of view of said receiving means comprises an instantaneous vertical field of view which is approximately twenty scan lines on said image means.

3. The trainer of claim 1 wherein the magnification by said receiving means is a factor greater than three.

4. The trainer of claim 1 wherein said image means comprises a monitor coupled to said processing means, and said processing means comprises a microprocessor.

5. The trainer of claim 4 wherein said monitor includes a cathode ray tube, and said microprocessor houses said circuit means.

6. A marksmanship trainer having various sensors and a computerized expert instructor that monitors, scores and provides feedback to the trainee, wherein the target image is visually displayed and controlled on a raster scan by the computer, and the trainee's weapon includes a long range light pen receiver that permits the trainee's aim point on the display to be tracked up to, and through, trigger squeeze, comprising:

means for representing in physical appearance of a weapon having a barrel, trigger mechanism and sight;

optical receiving means mounted for movement with said weapon means and aligned with said sight, for magnifying and continuously detecting a spot of light within its field of view;

means for providing an image visible to the trainee, wherein said spot of light detectable by said receiving means is scanned in a raster fashion;

circuit means coupled to said image means and said receiving means for determining the aim point by identifying the location of said spot of light at the pixel level when said spot of light is detected by said receiving means and correlating said aim point to said image;

processing means coupled to said circuit means and said image means for comparing the correlation between the aim point and the image to the criteria that corresponds to the quality of trainee performance, said processing means including a data acquisition analog-to-digital conversion broad;

wherein said trigger mechanism operable by said trainee including a pressure sensor that is electrically connected to said data broad and is responsive to the force applied by said trainee in manipulating said trigger mechanism, such that the quality of trainee performance in applying pressure to the trigger mechanism can be monitored and compared to the criteria that relates to the trigger manipulation; and, means responsive to said processing means for communicating corrective feedback to said trainee that is preselected for corresponding results of said comparison from data, said data is representative of an expert marksmanship instructor.

7. The trainer of claim 6 wherein said processing means further includes means for identifying the location of said aim point when the trigger is manipulated by the trainee, for comparing the location of said aim point to the location of said image, and for comparing the locations of a plurality of aim points corresponding to a plurality of trigger manipulations.

8. The trainer of claim 7 wherein said comparison of the correlation between the aim point and the image is categorized as good tracking, fair tracking and bad tracking, and said corrective feedback comprises a plurality of messages, wherein said plurality of messages includes;

"Assume A Steady Position" message when the comparison of said correlation achieves the criteria for the category of bad tracking;

"Good Shooting" message when the comparison achieves the correlation of the plurality of aim points and after the comparison failed to achieve for the category of bad tracking;

"Use Proper Trigger Squeeze" and "Freeze Your Breath" messages when the comparison achieves the criteria of the correlation of body movement and the correlation of trigger pressure, and after the comparison is categorized as good tracking and failed to achieve the criteria of the correlation of said plurality of aim points;

"Assume A Steady Position", "Use Proper Trigger Squeeze" and "Freeze Your Breath" messages when the comparison achieves the criteria of the correlation of body movement and the correlation of trigger pressure, and after the comparison failed to achieve the category of good tracking and the criteria of the correlation of said plurality of aim points;

"Freeze Your Breath" message when the comparison achieves the criteria of the correlation of body movement, and after the comparison is categorized as good tracking and failed to achieve the criteria of the correlation of said plurality of aim points and the correlation of said body movement and trigger pressure;

"Assume A Steady Position" and "Freeze Your Breath" messages when the comparison achieves the criteria of the correlation of body movement, and after the comparison failed to achieve the category of good tracking and the criteria of the correlation of said plurality of aim points and the correlation of said body movement and trigger pressure;

"Use Proper Trigger Squeeze" message when the comparison achieves the criteria of the correlation of said trigger pressure, and after the comparison is categorized as good tracking and failed to achieve the criteria of the correlation of said plurality of aim points, the correlation of said body movement and trigger pressure, and the correlation of said body movement;

"Assume A Steady Position" and "Use Proper Trigger Squeeze" messages when the comparison achieves the criteria of the correlation of said trigger pressure, and after the comparison failed to achieve the category of good tracking and the criteria of the correlation of said plurality of aim points, the correlation of said body movement and trigger pressure, and the correlation of said body movement; and "Use A Consistent Sight Picture" message when the comparison is categorized as good tracking, and failed to achieve the criteria of the correlation of said plurality of aim points, the correlation of said body movement and trigger pressure, and the correlation of said body movement.

9. The trainer of claim 6 further comprising a sensing device attached to said trainee for detecting the body movement indicative of breathing, wherein the sensing device is electrically connected to said data broad such that the quality of trainee performance in the cessation of body movement during and for a preselected period of time before manipulation of the trigger, can be compared to the additional criteria that relates to said breathing.

10. The trainer of claim 9 further comprising a mechanical recoil device attached to said weapon means and electrically connected to said data board, and responsive to the manipulation of said trigger by the trainee.

11. The trainer of claim 10 further comprising means electrically connected to of said data board for audibly communicating said corrective feedback to the trainee.

12. The trainer of claim 10 further comprising means for providing said feedback graphically to the trainee.

* * * * *